US009771765B2

(12) United States Patent
Coyle, Jr.

(10) Patent No.: US 9,771,765 B2
(45) Date of Patent: Sep. 26, 2017

(54) CONTROL LINE PUSHER ARM FOR DUAL COMPLETION WELL

(71) Applicant: Bilco Tools, Inc., Houma, LA (US)

(72) Inventor: William E. Coyle, Jr., Houma, LA (US)

(73) Assignee: Bilco Tools, Inc., Houma, LA (US)

( * ) Notice: Subject to any disclaimer, the term of this patent is extended or adjusted under 35 U.S.C. 154(b) by 87 days.

(21) Appl. No.: 14/826,392

(22) Filed: Aug. 14, 2015

(65) Prior Publication Data

US 2017/0044848 A1 Feb. 16, 2017

(51) Int. Cl.
*E21B 19/08* (2006.01)

(52) U.S. Cl.
CPC ..... *E21B 19/08* (2013.01)

(58) Field of Classification Search
CPC ..... E21B 19/08; E21B 17/026; E21B 17/1035
See application file for complete search history.

(56) References Cited

U.S. PATENT DOCUMENTS 3,543,615 A * 12/1970 Cudnohufsky ..... B23B 25/00 82/11.1
7,249,637 B2 * 7/2007 Hayes ..... E21B 17/1035 166/241.5
2015/0107850 A1 * 4/2015 Mosing ..... E21B 19/165 166/377

* cited by examiner

*Primary Examiner* — Cathleen Hutchins
*Assistant Examiner* — Ronald Runyan
(74) *Attorney, Agent, or Firm* — Patrick K. Steele

(57) ABSTRACT

An umbilical manipulator arm for positioning control lines for being secured to a plurality of tubular strings being made up and run into a dual completion wellbore includes a carriage movable on a base that is securable to a rig floor adjacent to two tubular strings. An umbilical manipulator arm is coupled to the carriage and movable relative to the carriage between a pusher arm retracted position distal to a tubular string and a pusher arm engaged position proximal to a tubular string. The carriage is movable between a carriage first position proximal to a first tubular string and a carriage second position proximal to a second tubular string. The umbilical manipulator arm can be used to position control lines for being secured to the plurality of tubular strings as they are being made up and run into the wellbore.

10 Claims, 6 Drawing Sheets

CONTROL LINE PUSHER ARM FOR DUAL COMPLETION WELL

BACKGROUND

Field of the Invention

The present invention relates to a control line pusher arm for use in positioning control lines to be secured to two parallel tubular strings being run into a dual completion well.

Background of the Related Art

In a dual well completion, a single wellbore has a plurality of tubular strings in addition to related packers and other tools to enable production from two different and isolated geologic zones. Generally, two tubing strings are used to provide the necessary level of control, safety and segregation between fluids from the two different subsurface geological zones penetrated by a single, dual-completion wellbore.

A control line pusher arm is used on a rig for positioning an elongate control line, also called an umbilical, so that it can be secured to a tubular string as the tubular string is made up and run into a wellbore. A conventional control line pusher arm moves between a retracted position, distal to the tubular string, and an engaged position, proximal to the tubular string, to move an adjacent portion of a control line proximal to the tubular string so that a clamp or other securing member can be applied to secure the portion of the control line to the adjacent portion of the tubular string.

What is needed is a control line pusher arm that can be used to position a plurality of control lines for being secured to a plurality of tubular strings being run into a single wellbore.

BRIEF SUMMARY

One embodiment of the present invention provides a control line pusher arm for use in positioning two control lines for securing one of the control lines to a first tubular string and for securing the other of the control lines to a second tubular string wherein the first tubular string and the second tubular string are together being run into a dual-completion wellbore.

A first embodiment of the apparatus of the present invention comprises a base supportable on a rig floor, a carriage coupled to the base and movable relative to the base between a first position and a second position, a pusher arm pivotally coupled at a lower end to the carriage and pivotable between a retracted position and an engaged position to position a control line head coupled to a second end of the pusher arm, a first motive member coupled intermediate the carriage and the pusher arm to pivot the pusher arm between the retracted position and the engaged position, and a second motive member coupled intermediate the carriage and the base to move the carriage between the first position and the second position. The apparatus may further comprise a worm gear coupled to the base to rotate about an axis by operation of the second motive member, wherein the carriage includes a plurality of teeth engaged by the worm gear. In one embodiment of the apparatus comprising a worm gear coupled to the base to rotate by operation of the second motive member, the second motive member is a hydraulic motor. Alternately, in another embodiment of the apparatus that comprises a worm gear, the worm gear is coupled to the carriage to rotate about an axis by operation of the second motive member, and the base includes a plurality of teeth engaged by the worm gear. In one embodiment of the apparatus comprising a worm gear coupled to the carriage to rotate by operation of the second motive member, the second motive member is a hydraulic motor.

In one embodiment of the apparatus, the first motive member of the apparatus that moves the pusher arm to pivot between the retracted position and the engaged position may comprise a fluid cylinder coupled at a first end to the carriage and coupled at a second end to the pusher arm and operable to pivot the pusher arm between the retracted position and the engaged position.

In one embodiment of the apparatus, the second motive member of the apparatus that moves the carriage between the first position and the second position comprises a fluid cylinder.

In one embodiment of the apparatus, the second motive member of the apparatus that moves the carriage between the first position and the second position comprises a worm gear disposed intermediate the carriage and the base.

In one embodiment of the apparatus, the carriage is slidably coupled to the base.

In one embodiment of the apparatus, the carriage is translatably moved between the first position and the second position on the base.

DETAILED DESCRIPTION

Figure 1:
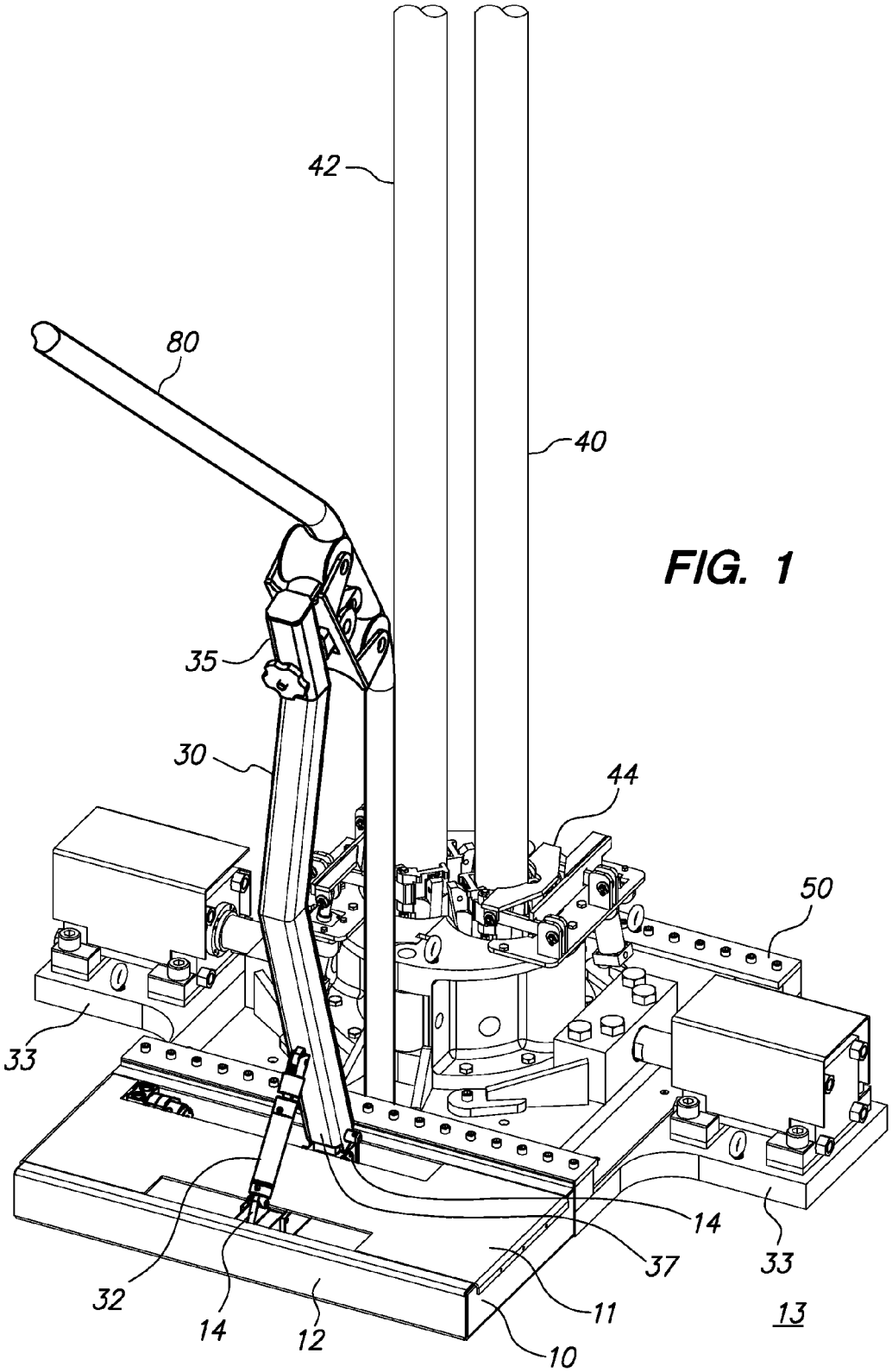
FIG. 1 is a perspective view of an embodiment of an apparatus of the present invention with a pivotal pusher arm in a first position that is proximal to a first tubular string in a dual completion well and with the pusher arm in the retracted position.
Figure 2:
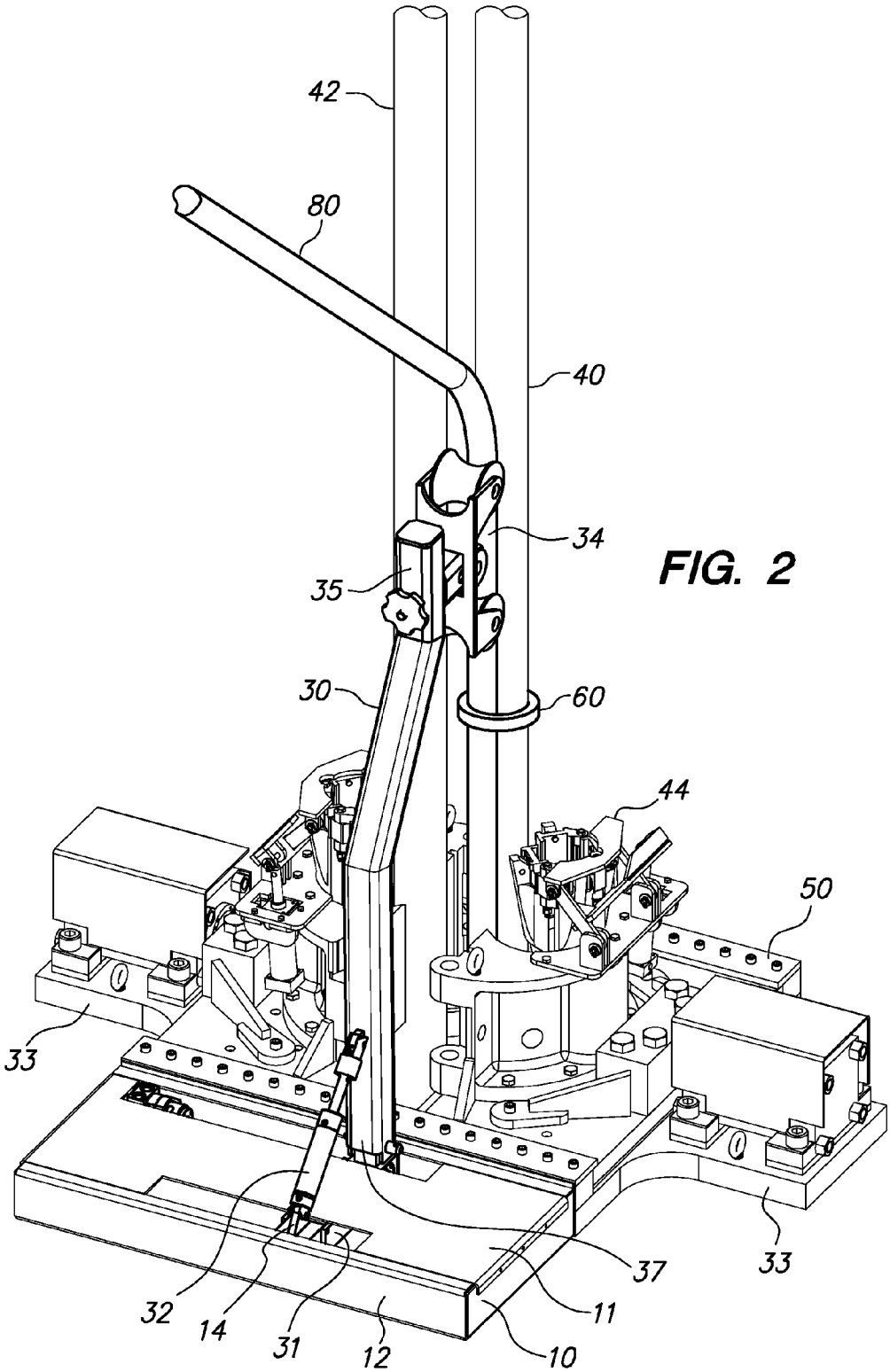
FIG. 2 is the perspective view of the embodiment of the apparatus of FIG. 1 after the pusher arm is pivoted from the retracted position illustrated in FIG. 1 to an engaged position to position a portion of a first control line proximal to the first tubular string in a dual completion well to enable the application of a clamp to secure the portion of the first control line to the first tubular string.

One embodiment of the apparatus of the present invention is illustrated in FIG. 1. FIG. 1 is a perspective view of an embodiment of the apparatus 10 supported on a rig floor 13. FIG. 1 shows a first tubular string 40 and a second tubular string 42 extending generally vertically into a dual completion well (not shown). The apparatus 10 comprises a pusher arm 30 pivotally coupled at a lower end 37 to a carriage 14. The pusher arm 30 is pivotally coupled to the carriage 14 and movable relative to the carriage 14 between an arm-retracted position, illustrated in FIG. 1, to an arm-engaged position, as illustrated in FIG. 2 and discussed below. The carriage 14 translates on a base 12 of the apparatus 10 between a carriage first position, proximal to the first tubular string 40 and illustrated in FIG. 1, to a carriage second position.

FIG. 2 is the perspective view of FIG. 1 after the pusher arm 30 pivots from the arm-retracted position, illustrated in FIG. 1, to the arm-engaged position to position a portion of the control line 80 proximal to the first tubular string 40. The first motive member 32, a fluid cylinder, is illustrated as being coupled intermediate the pusher arm 30 and the carriage 14. The first motive member is coupled to the carriage 14 at a location that is spaced-apart from the location where the pusher arm 30 is pivotally coupled to impart on the pusher arm 30 a force having a component that will cause the pusher arm 30 to rotate from the pusher arm-retracted position, illustrated in FIG. 1, towards the first tubular string 40 and to the pusher arm-engaged position, illustrated in FIG. 2. The movement of the pusher arm 30 to the pusher arm-engaged position moves the control line 80 to a position enabling the application of the clamp 60 to secure the control line 80 to the first tubular string 40.

Figure 3:
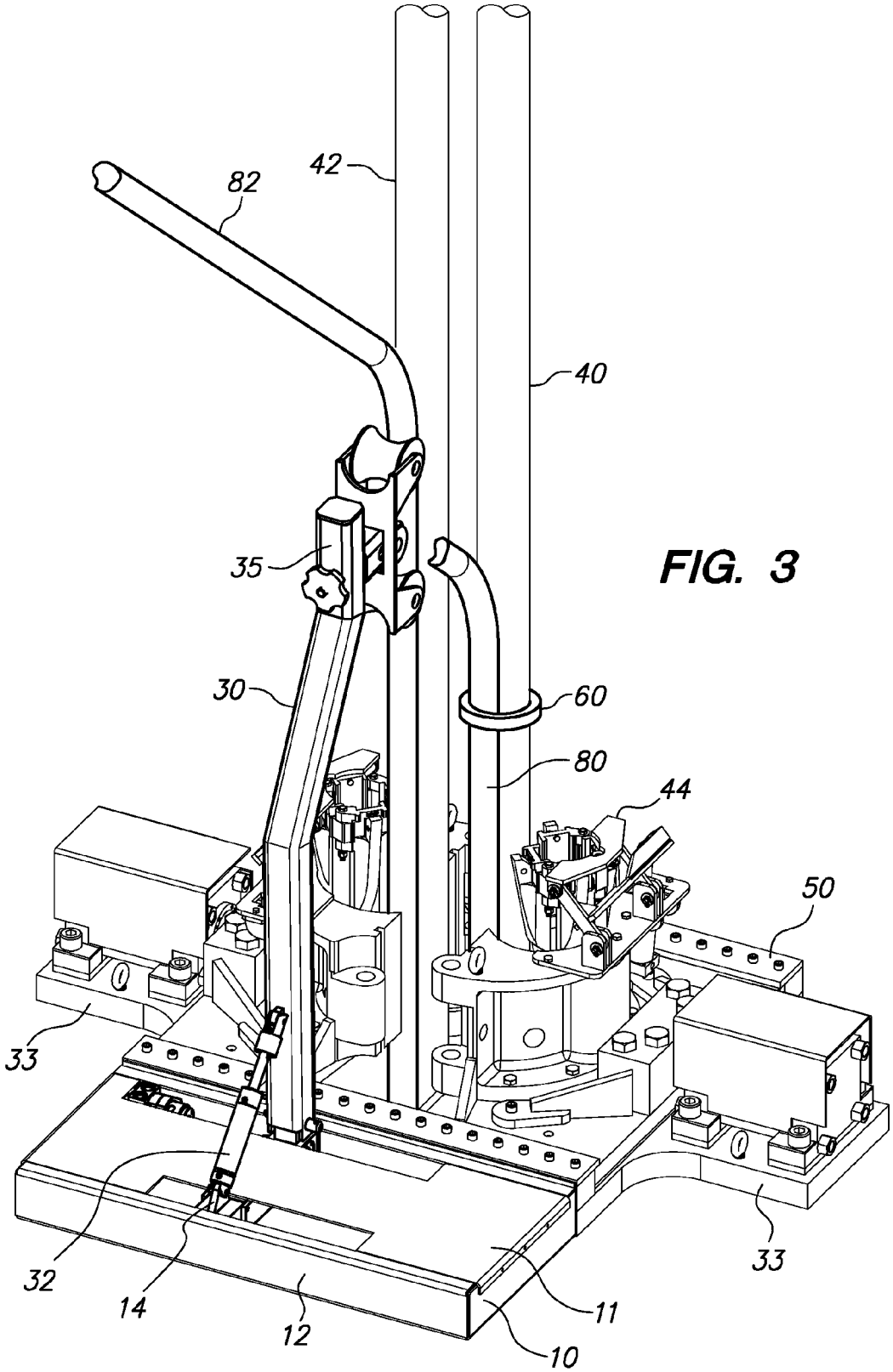
FIG. 3 is the perspective view of the embodiment of the apparatus of FIG. 2 after the pusher arm is retracted away from the first tubular string (to the position illustrated in FIG. 1), the pusher arm is translated laterally to a second position that is proximal to a second tubular string adjacent to the first tubular string in the dual completion well, and the pusher arm is pivoted from the retracted position to the engaged position to position a portion of a control line proximal to a second tubular string to enable the application of a clamp to secure the portion of a second control line to the second tubular string.

FIG. 3 is the perspective view of FIG. 2 after the pusher arm 30 is retracted away from the first tubular string 40 (to return to the pusher arm-retracted position illustrated in FIG. 1), translated laterally to a second position that is proximal to a second tubular string 42 that is adjacent to the first tubular string 40, and then again pivoted from the pusher-arm retracted position to the pusher arm engaged position to position a portion of a second control line 82 proximal to the second tubular string 42 to enable the application of a clamp (not shown) similar to the clamp 60 shown in FIG. 3 as securing the first control line 80 to the first tubular string 40.

Figure 4:
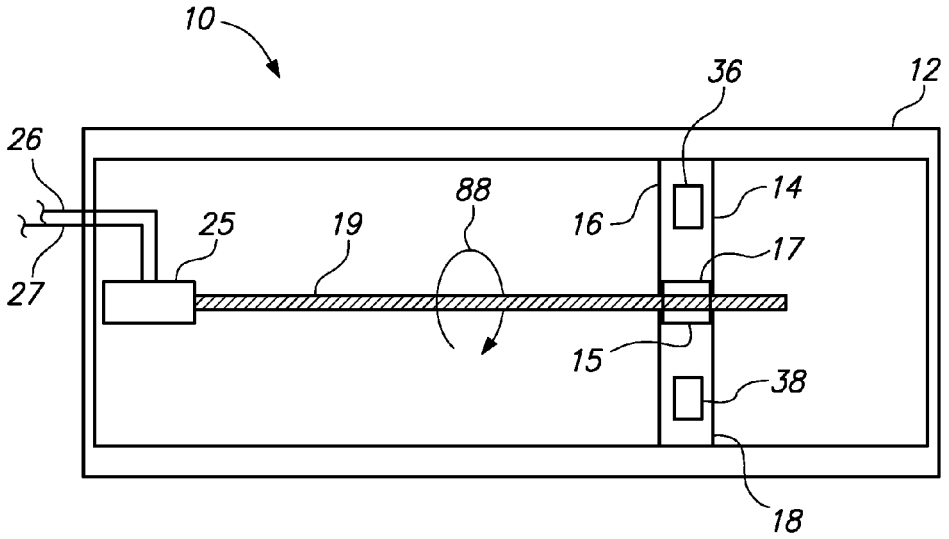
FIG. 4 is a plan view of the base and the carriage of the embodiment of the apparatus of FIGS. 1-3, and of the motor and threaded shaft arrangement for moving the carriage on the base and between the first position and the second position.

FIG. 4 is a plan view of the base 12 and the carriage 14 of the apparatus 10 of FIGS. 1-3, and of a motor 25 on the base 12 that, when activated, drives a threaded shaft 19 to rotate in the direction indicated by arrow 88. FIG. 4 further reveals a proximal end 16 of the carriage, a distal end 18 of the carriage 14, and an internally-threaded nut 17 secured within a well 15 on the carriage 14 between the proximal end 16 and the distal end 18 of the carriage 14. The shaft 19 is threadably engaged with the internally-threaded nut 17 secured within the well 15 on the carriage 14 intermediate the proximal end 16 and the distal end 18. Upon activation of the motor 25 by one of an electrical current and a hydraulic circuit (meaning hydraulic pressure on one side, and relatively less hydraulic pressure on the other) through one of electrical and hydraulic conduits 26 and 27, respectively, the shaft 19 rotates to move the carriage 14 on the base 12 between the carriage first position, illustrated in FIG. 1, and the carriage second position illustrated in FIG. 3. It will be understood that the carriage 14 could be moved between the carriage first position, illustrated in FIG. 1, and the carriage second position illustrated in FIG. 3, using other motive members such as, for example, a double-acting fluid cylinder disposed intermediate the base 12 and the carriage 14, an electromagnet on one of the base 12 and the carriage 14 and a magnet disposed on the other of the base 12 and the carriage 14, and a worm gear coupled intermediate the base 12 and the carriage 14.

Figure 5:
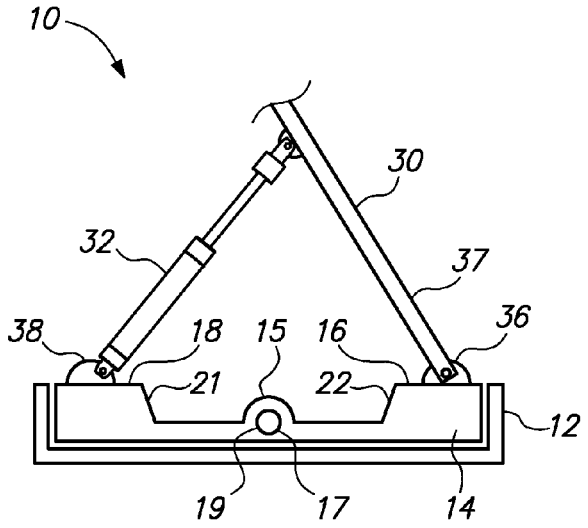
FIG. 5 is an elevation view of a portion of the apparatus showing the interaction between the pivotal pusher arm and a pivotal first motive member, between the carriage and the base of the apparatus, and between the carriage and the threaded shaft that is driven to rotate about an axis by a second motive member (not shown in FIG. 5—see FIG. 4) to move the carriage on the base.

FIG. 5 is an elevation view of a portion of the apparatus 10 showing the interaction between the pusher arm 30 and the first motive member 32, and also between the carriage 14 and the threaded shaft 19 driven by the second motive member (not shown in FIG. 5—see FIG. 4). FIG. 5 shows a proximal end 16 of the carriage 14 and a distal end 18 of the carriage, and the carriage 14 slidably seated within the base 12 intermediate proximal wall 22 and distal wall 21. The threaded shaft 19 is threadably received within the internally threaded nut 17 of the carriage 14. The first motive member 32 is a fluid cylinder that is pivotally coupled to an ear 38 on the carriage 14. It will be understood that the extension of the first motive member 32 pivots the pusher arm 30 in the clockwise direction about the proximal ear 36 and retraction of the first motive member 32 pivots the pusher arm 30 in the counterclockwise direction about the proximal ear 36.

Figure 6:
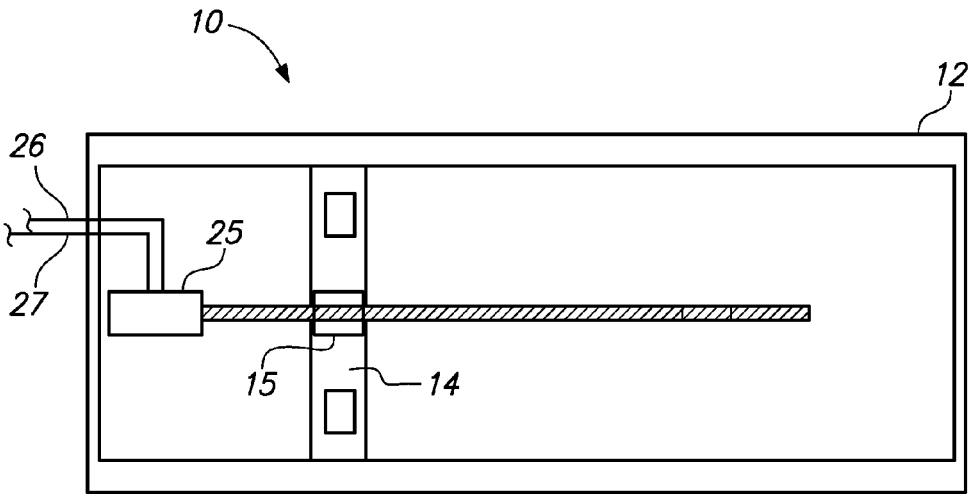
FIG. 6 is the plan view of FIG. 4 after the carriage is moved by operation of the second motive member from the first position (see FIG. 4) to the second position.

FIG. 6 is the plan view of FIG. 4 after the carriage 14 is moved on the base 12 from the first position (see FIGS. 1, 2 and 4), with the carriage 14 proximal to the first tubular string 40 (not shown in FIG. 6—see FIG. 1), to the second position (see FIG. 3), with the carriage 14 proximal to the second tubular string 42.

Figure 7:
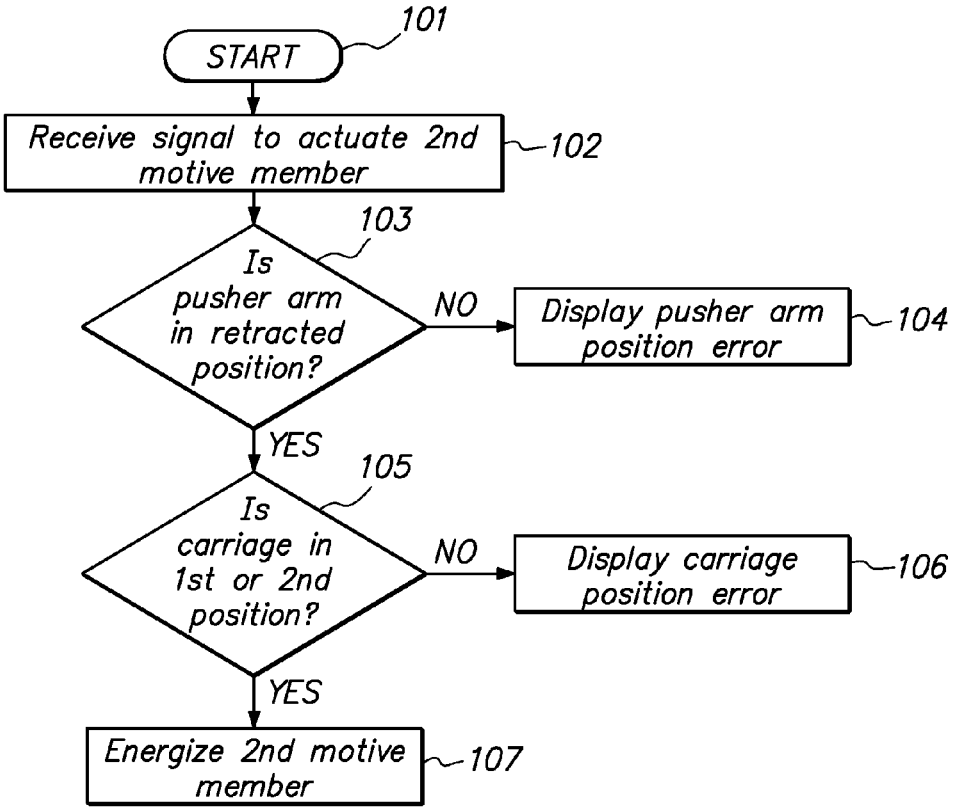
FIG. 7 is a flowchart illustrating the logic followed by a safety lockout system that protects the carriage from being moved between the first position and the second position while the pusher arm is engaged with a control line.

FIG. 7 is a high-level flowchart illustrating steps for automatically protecting the apparatus 10 and the tubular strings 40 and 42 against damage that may be caused by inadvertently operating the second motive member 25 of the apparatus 10 when the pusher arm 30 is engaged with the first control line 80 or the second control line 82. The flowchart of FIG. 7 illustrates the steps performed by a processor and beginning at step 101. In step 102, the signal to actuate the second motive member 25 is received. In step 103, the position of the pusher arm 30 is determined and, if the pusher arm is in the retracted position so that it can be moved along with the carriage between the pusher arm first position and the pusher arm second position then, in step 105, the position of the carriage 14 on the base 12 is determined. If the carriage 14 is determined to be in one of the carriage first position and the carriage second position, corresponding to a position proximal to the first tubular string 40 and a position proximal to the second tubular string 42 then, in step 107, the circuit is activated and the second motive member 25 is energized so that the carriage 14 is moved from the carriage first position to the carriage second position, or vice versa.

In the event that it is determined in step 103 that the pusher arm is not in the retracted position then, in step 104, an error message is displayed to alert rig personnel that not all of the conditions for energizing the second motive member 25 exist. In the event that it is determined in step 105 that the carriage is not in the first position or the carriage second position then, in step 106, an error message is displayed to alert rig personnel that not all of the conditions for energizing the second motive member 25 exist. It will be understood that the apparatus 10 may comprise switches and sensors that generate a signal when, for example, the pusher arm 30 is in the pusher arm retracted position or when, for example, the carriage 14 is in the carriage first position and/or in the carriage second position. It will be understood that such switches and sensors are easily and conveniently secured to the base, the carriage, the first motive member and/or the pusher arm of the apparatus.

It will be understood that the second motive member 25 can, in one embodiment, be an electrically powered motor, and the conduits 26 and 27 in FIG. 4 are electrical conductors such as, for example, a pair of wires. In another embodiment, the second motive member 25 can be a hydraulically powered motor, and the conduits 26 and 27 in FIG. 4 are hydraulic conduits such as, for example, metal tubing. In a preferred embodiment, the second motive member 25 is a pneumatically powered motor, and the conduits 26 and 27 in FIG. 4 are pneumatic conduits such as, for example, metal tubing.

Figure 8:
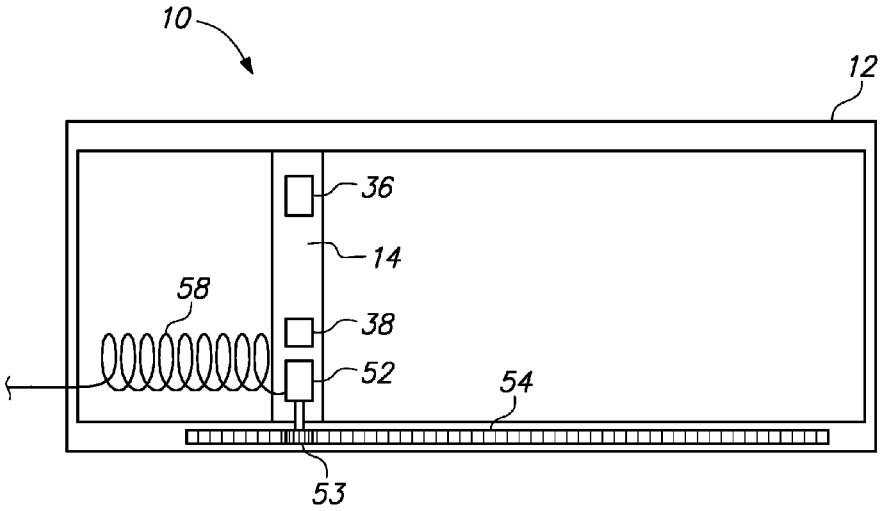
FIG. 8 illustrates an alternate second motive member that is secured to the carriage and operable to engage a rack including a row of teeth along an edge of the base.
Figure 9:
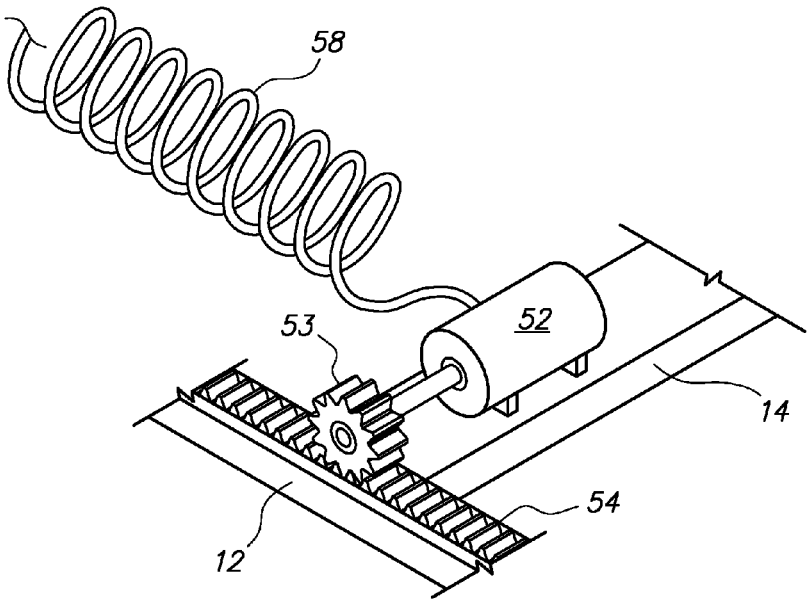
FIG. 9 is an enlarged view of the motive member, the carriage on which it moves and the rack engaged by the motive member through the gear disposed on the motive member.

It will be understood that the second motive member 25 can provide for movement between the base 12 and the carriage 14 in other ways other than through the use of the threaded shaft 19 coupled to the base 12 and the internally-threaded nut 17 on the carriage 14, as illustrated in FIG. 4. For example, but not by way of limitation, FIG. 8 illustrates an alternate second motive member 52 that is secured to the carriage 14 and operable to engage a rack 54 including a row of teeth along an edge of the base 12. The alternate second motive member 52 rotates a gear 53 that engages the rack 54 and, depending on the rotational direction of the gear 53, the carriage 14 will move along the base 12 in response to the rotation of the gear 53 by the alternate second motive member 52. It should be noted that, in the embodiment of the apparatus 10 illustrated in FIGS. 8 and 9, the alternate second motive member 52 moves with the carriage 14. To provide continuous power to the alternate second motive member 52, a coiled power delivery conduit 58 can be used. It will be understood that, in FIG. 8 for example, if the alternate second motive member 52 is operated to move the carriage 14 on the base 12 from left to right in FIG. 8, the conduit 58 will extend so that continuous power is delivered through the conduit 58 to the alternate second motive member 52 on the carriage 14 as it moves. It will be further understood that the alternate second motive member in FIGS. 8 and 9 may be, in one embodiment, an electric motor and the conduit 58 can be a pair of conductive wires or, in another embodiment, the alternate second motive member 52 can be a hydraulic or pneumatic motor and the conduit can be one of a pair of hydraulic hoses or a pneumatic hose.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An apparatus, comprising:

a base supportable on a rig floor adjacent to a dual-completion well having a first tubular string and a second tubular string;

a carriage coupled to the base and translatably movable along the base between a carriage first position, proximal to the first tubular string, and a carriage second position proximal to the second tubular string;

a pusher arm pivotally coupled at a lower end to the carriage and pivotable between a pusher arm retracted position and a pusher arm engaged position to position a control line head coupled to a second end of the pusher arm;

a first motive member coupled intermediate the carriage and the pusher arm to pivot the pusher arm between the pusher arm retracted position and the pusher arm engaged position; and a second motive member coupled intermediate the carriage and the base to move the carriage between the carriage first position and the carriage second position.

2. The apparatus of claim 1, further comprising:

a threaded shaft coupled to the base and rotatable about an axis by the second motive member;

wherein the carriage includes an internally threaded nut engaged by the threaded shaft.

3. The apparatus of claim 2, wherein the second motive member is a hydraulic motor.

4. The apparatus of claim 1, further comprising:

a gear coupled to the base to rotate about an axis by operation of the second motive member;

wherein the carriage includes a plurality of teeth engaged by the gear.

5. The apparatus of claim 4, wherein the second motive member is a hydraulic motor.

6. The apparatus of claim 1, wherein the first motive member comprises a fluid cylinder coupled at a first end to the carriage and at a second end to the pusher arm, and activatable to pivot the pusher arm between the pusher arm retracted position and the pusher arm engaged position.

7. The apparatus of claim 1, wherein the second motive member drives a gear disposed intermediate the carriage and the base.

8. The apparatus of claim 1, wherein the first motive member is one of a hydraulically powered motor and a pneumatically powered motor.

9. The apparatus of claim 8, wherein the second motive member is one of an electrically powered motor, a hydraulically powered motor and a pneumatically powered motor.

10. The apparatus of claim 1, wherein the carriage is slidably coupled to the base.

* * * * *